United States Patent [19]

Bauer

[11] 4,425,734

[45] Jan. 17, 1984

[54] FLAT-PACKAGED AIR GLIDER TOY

[76] Inventor: Peter Bauer, 13921 Esworthy Rd., Germantown, Md. 20767

[21] Appl. No.: 275,368

[22] Filed: Jun. 19, 1981

Related U.S. Application Data

[63] Continuation of Ser. No. 143,436, Apr. 24, 1980, abandoned.

[51] Int. Cl.[3] ..... A63H 33/18

[52] U.S. Cl. ..... 46/74 D; 2/200

[58] Field of Search ..... 46/74 D, 1 F, 1 L, 1 R, 46/74 R; 273/424, 425; D21/86; 2/200, 196, 177, 175, 46, 273

[56] References Cited

U.S. PATENT DOCUMENTS

D. 214,577 7/1969 Mueller ..... D21/86
D. 221,453 8/1971 Swanberg ..... D21/86
2,007,235 7/1935 Woodside ..... 2/175
2,113,432 4/1938 Paige ..... 46/1 R UX
4,115,946 9/1978 Vukmirovich ..... 46/74 D

FOREIGN PATENT DOCUMENTS 1019163 2/1966 United Kingdom ..... 2/200

*Primary Examiner*—Mickey Yu
*Attorney, Agent, or Firm*—Griffin, Branigan & Butler

[57] ABSTRACT

A flying saucer type toy is made suitable for indoor use by relying on spin velocity, rather than translational velocity, to effect lift. A flat disc is provided with plural generally spiral through-cuts to define plural spiral blade members therebetween. The center of the disc is raised relative to the rim so that the blade members extend between the planes of the disc center and rim and provide lift when the disc is spun about an axis perpendicular to the disc.

8 Claims, 9 Drawing Figures

FLAT-PACKAGED AIR GLIDER TOY

RELATED APPLICATIONS

This application is a continuation of application Ser. No. 143,436 filed Apr. 24, 1980, now abandoned.

TECHNICAL FIELD

The present invention relates to disc-like toys of the type which glide through the air when caused to spin about a central axis disposed perpendicular to the disc.

BACKGROUND OF THE INVENTION

Aerodynamic toys which resemble flying saucers have gained a significant degree of popularity. Such toys are usually thrown by hand, using a wrist-snapping motion, whereby a spinning motion is imparted to the toy. The toy is contoured to impart a lift force thereto in response to the spinning motion.

As a general rule, toys of the type described are strictly for outdoor use. There is a two-fold reason for this. On the one hand, the toys are designed to be thrown across distances and at heights which exceed the dimensions of the rooms found in most homes; on the other hand, these toys are made of molded plastic which is so hard as to be likely to cause damage to the furniture and other household items which might be struck.

It is therefore one object of the present invention to provide a toy of the type described which is suitable for both indoor and outdoor use.

It is also typical that the type of toy described requires a significant thickness in order that it may operate aerodynamically and experience lift once spinning. Such thickness precludes the flat packaging that would be desirable for efficient shipping and necessary if the toy were to be included as a give-away item in a package of breakfast cereal or the like.

It is therefore another object of the present invention to provide a toy of the type described wherein the thickness dimension is negligible for purposes of packaging.

SUMMARY OF THE INVENTION

In accordance to the present invention, a disc-like member is provided with a plurality of through-cuts of generally spiral shape. The disc is flat for purposes of packaging but may be bowed or domed in an upwardly convex configuration, whereupon the blade-like sections subsisting between the spiral cuts provide lift surfaces having exposed edges. When the device is spun, air rushes along the blade lift surfaces to provide a lift force related to the spin velocity. Bowing of the disc may be effected by rotating the disc center relative to the disc periphery and may be achieved by means of a cross piece or strip configured so that its ends engage slots in the disc. The slots are positioned to cause the disc to bow when engaged by the cross piece. Alternatively, the blade surfaces may be folded to effect a domed configuration, thereby eliminating the need for a cross piece. Preferably, the parts are made of cardboard, heavy paper, flat plastic, or the like.

BRIEF DESCRIPTION OF THE DRAWINGS

The above and still further objects, features and advantages of the present invention will become apparent upon consideration of the following detailed description of the plural embodiments thereof, especially when taken in conjunction with the accompanying drawings, wherein.

DESCRIPTION OF THE PREFERRED EMBODIMENTS

Figure 1:
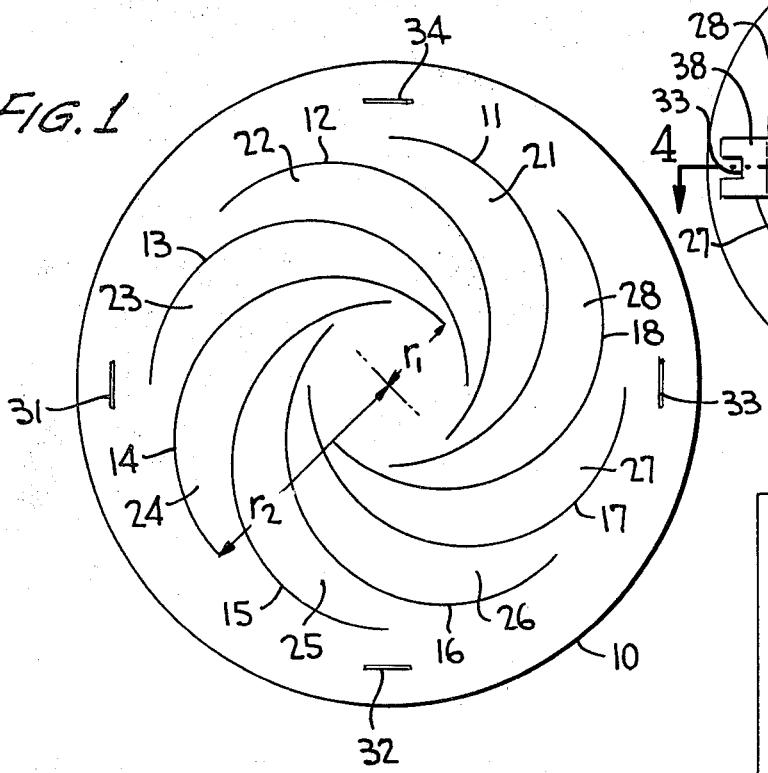
FIG. 1 is a top view in plan of a disc employed in one embodiment of the present invention.

Referring specifically to FIG. 1 of the accompanying drawings, there is illustrated a flat disc 10 in the form of a circular piece of flat cardboard, heavy paper, plastic, etc. Whichever material is used, it is important that the disc be semi-rigid, that is be sufficiently rigid to remain substantially planar when supported along a part of its periphery yet sufficiently flexible to permit the flexure required in the following description. A plurality of through-cuts 11 through 18 are defined through disc 10. Eight such through-cuts are illustrated in the embodiment of FIGS. 1 through 5; however, this number of through-cuts is not to be construed as limiting upon the scope of the present invention. The through-cuts 11 through 18 are successively equally spaced and begin at a relatively small radial distance $r_1$ from the center of the disc 10 and extend over an arc of 180° to a radial distance $r_2$ from the disc center. The length of the cut can vary from 180° and the cuts need not be part of a circle but rather can have a diameter which varies along the length of the cut. In any case, the centers of the through-cuts are not coincident with the center of disc 10 so that through-cuts provide an overall spiral configuration. The disc regions between the through-cuts 11 through 18 are spiral-shaped blade members 21 through 28 which are integral parts of the disc at their ends and are deformable out of plane relative to one another.

Figure 2:
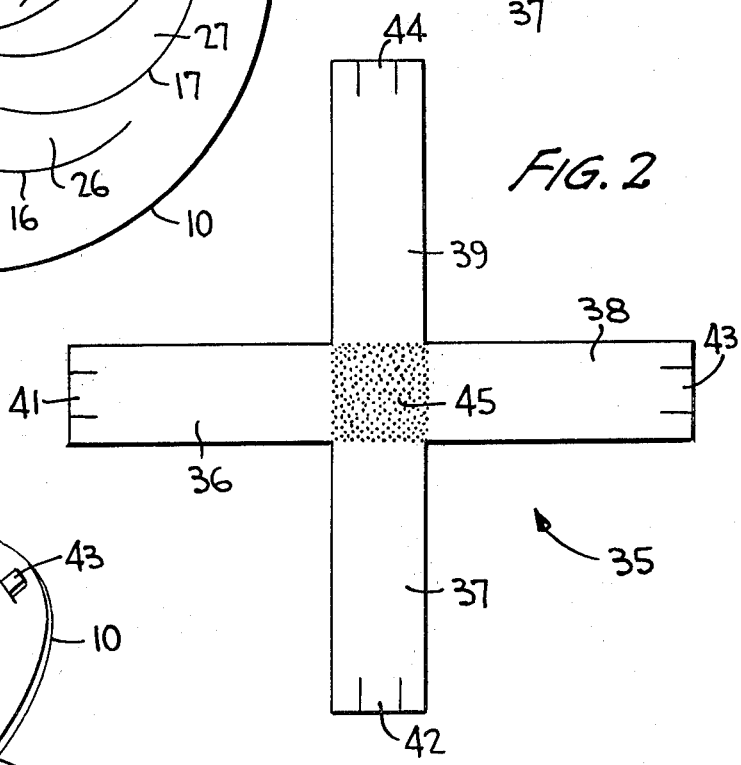
FIG. 2 is a top view in plan of a cross piece suitable for use in effecting bowing of the disc of FIG. 1.

Four slots 31, 32, 33 and 34 are at 90°-spaced locations along the periphery of disc 10. The slots extend lengthwise perpendicular to the respective radii of the disc. The slot locations are spaced from the disc center by a distance greater than the radius $r_2$ at which the cuts 11 through 18 and members 21 through 28 terminate. As illustrated in FIG. 2, a cross-piece 35, preferably made from the same material as disc 10, is in the shape of a cross. Alternatively, cross-piece 35 may be formed from two individual rectangular members joined at their overlapped centers to form the cross. Cross-piece 35 includes four legs, 36, 37, 38 and 39 extending at 90° locations from the cross center. The maximum length of the cross-piece 35 between the ends of opposite legs is less than the diameter of disc 10. The ends of the legs 36, 37, 38 and 39 each have respective radially extending tabs 41, 42, 43 and 44 defined therein between a pair of short through-cuts in the legs, extending radially inward from the outer end of the leg.

Figure 3:
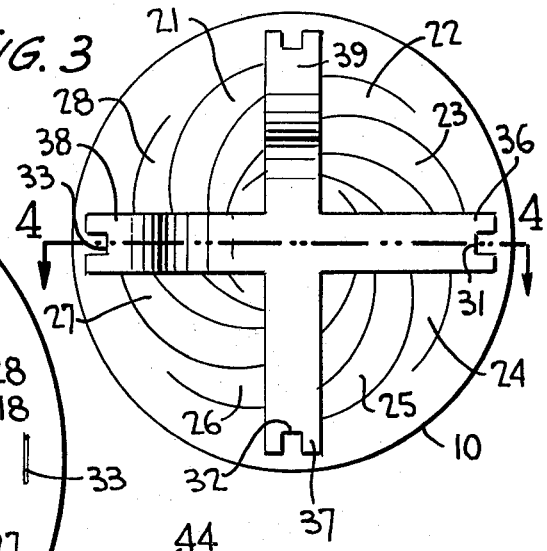
FIG. 3 is a bottom view in plan of the disc of FIG. 1 and cross piece of FIG. 2 joined together in a toy assembly according to the present invention.
Figure 4:
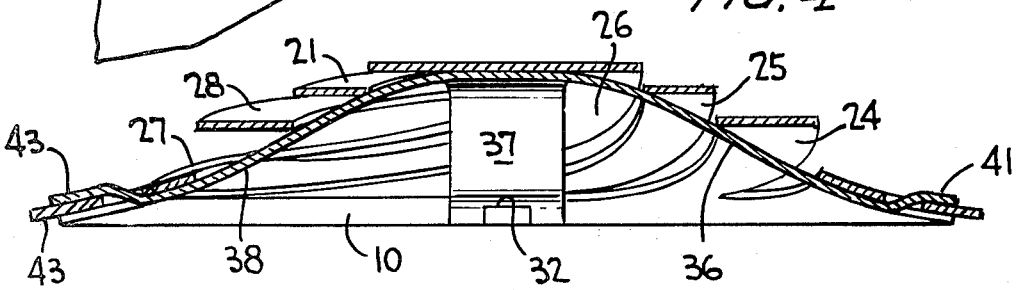
FIG. 4 is a view in section taken along lines IV—IV of FIG. 3.

Cross-piece 35 is adapted to be secured to the underside of disc 10 as best seen in FIGS. 3 and 4. The center region of a cross-piece (which may have its upper surface treated with adhesive 45 as illustrated in FIG. 2) is secured against the undersurface of the center of the disc. Tabs 41, 42, 43 and 44 are adapted to be inserted in the disc slots 31, 32, 33 and 34, respectively. The distance between opposite slots (for example, slots 31, 33) is less than the distance between the innermost parts of corresponding opposite tabs (for example 41, 43) so that the cross-piece 35 forces the center of disc 10 upward relative to the disc rim and thereby creates a dome effect 3. This dome effect is most clearly seen in FIG. 4 wherein the spiral elements 21 through 28 are shown extending spirally out of the plane of the disc rim, much like fan blades.

Figure 5:
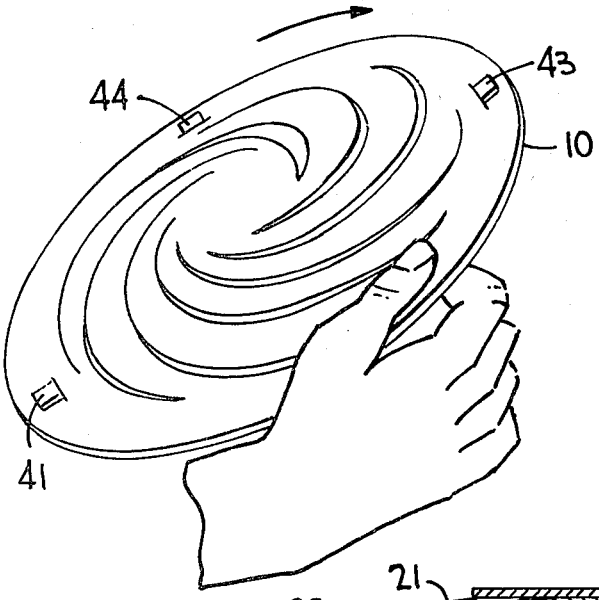
FIG. 5 is a view in perspective of the embodiment of FIGS. 3 and 4 in use.

If the domed device is spun through the air about an axis extending perpendicular to the plane of the disc rim (e.g., as by snapping one's wrist in the manner illustrated in FIG. 5), the rush of air along the surfaces of blade members 21 through 28 produces a lift force related to the spin velocity. Unlike the conventional flying saucer type toys (for example, the "Frisbee") which are intended for outdoor use and which achieve lift due to translational movement, the apparatus of the present invention can be spun without translational movement and still experience lift. This spinning motion also imparts a gyroscopic stability to the device as is the case with conventional flying saucer toys. The feature of imparting lift without translational movement makes the device of the present invention ideal for utilization in confined spaces, such as indoors.

Figure 6:
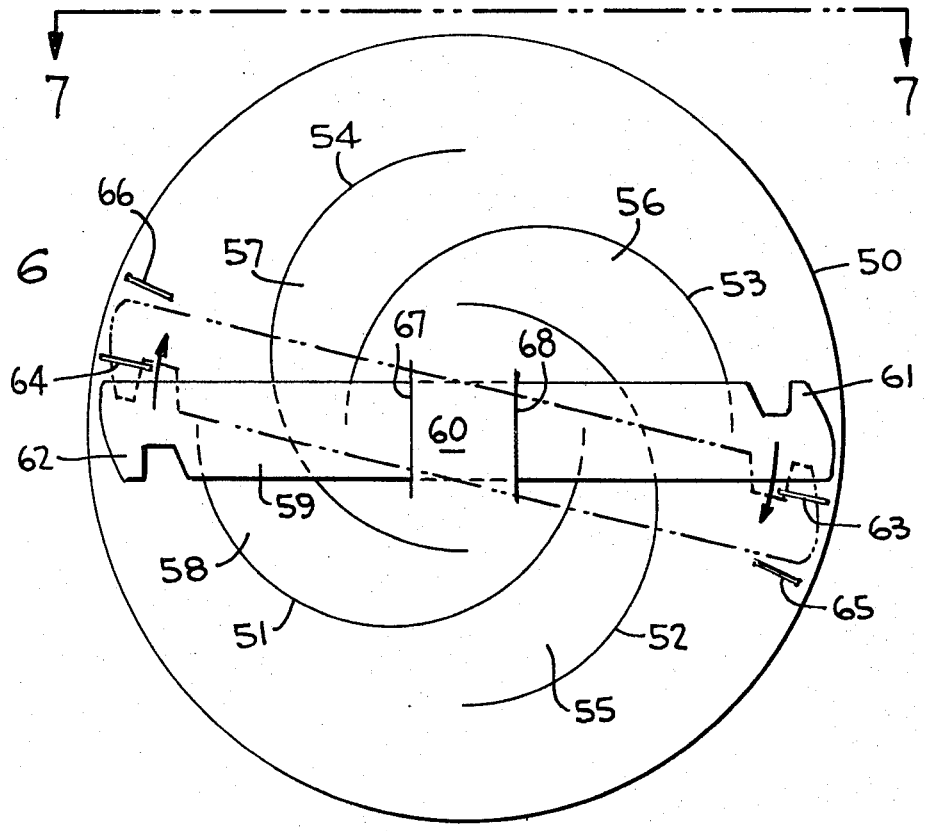
FIG. 6 is a bottom plan view, partially diagrammatic, of another embodiment of the present invention.
Figure 7:
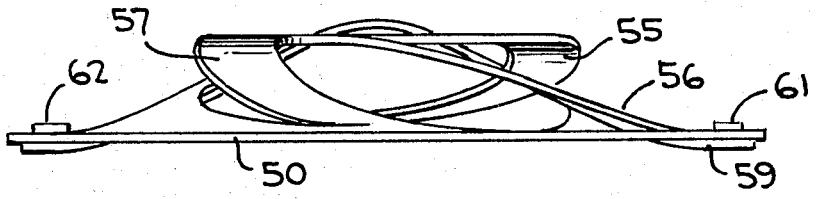
FIG. 7 is an elevation view taken along lines VII—VII of FIG. 6.

The doming effect required to bring blade members 21 through 28 out of plane is produced in the device of FIGS. 1–4 by making the distance between tabs 41 and 43 greater than the distance between slots 31 and 33 (and the distance between tabs 42 and 44 greater than the distance between slots 32 and 34) so that the cross-piece 35, when placed flush along the underside of the disc 10, pushes the center of the disc out of the plane of the disc rim. There are, however, other ways of achieving this doming effect, one of which is illustrated in FIGS. 6 and 7. Specifically, a disc 50, constructed according to the same considerations set forth for disc 10, has plural through-cuts 51 through 54 defining spiral blade members 55 through 58 therebetween. Through-cuts 51 through 54 are made in accordance with the same considerations set forth for through-cuts 11 through 18. A first pair of diametrically opposed and radially extending slots 63, 64 are defined proximate the disc periphery. Spaced at a small angle from these slots is a second pair of diametrically opposed and radially extending slots 65, 66.

Instead of cross-piece 35, a strip 59 is provided and includes tangentially extending tabs 61, 62 at its opposite ends. Tabs 61, 62 extend in the same rotational direction; that is, they extend transverse to the longitudinal dimension of strip 59 on opposite sides of the strip. Tabs 61 and 62 are spaced from one another by the same distance subsisting between slots 63 and 64 as well as the distance between slots 65 and 66.

Strip 59 is adapted to be engaged by a web 60 formed at the center of disc 50 between two parallel through-cuts 67, 68 made on opposite sides and equidistant from the disc-center. When held by web 60 in an unstressed condition, strip 59 is positioned so that tabs 61 and 62 are angularly off-set from and not engageable with either pair of slots 63, 64 or 65, 66. Under such circumstances the disc remains planar. If, however, strip 59 is rotated slightly against the constraints provided by the ends of the through-cuts 67, 68 forming web 60, tabs 61 and 62 may be inserted into slots 63 and 64, respectively. This produces a rotational stress in the disc, causing the center of the disc or web 60 to be angularly displaced relative to the disc rim or periphery. The rotational stress thus created causes the blade members 55 through 58 to be displaced angularly, thereby forcing the disc center out of the plane of the disc rim until equilibrium is achieved. This condition is illustrated clearly in FIG. 7. The disc is thus caused to achieve a dome configuration by the rotation of strip 59 against the constraint established at the disc center. A more pronounced doming effect may be provided by rotating strip 59 further so as to permit tabs 61, 62 to engage the slots 65, 66. In either case, the constraint at the disc center need not be provided by a web 60 but can be effected by securing the strip center to the disc center in any suitable manner, such as by adhesive, staples, etc. Likewise, the ends of the strip need not engage the disc periphery in a tab-slot arrangement but may instead be glued, stapled, etc.

Figure 8:
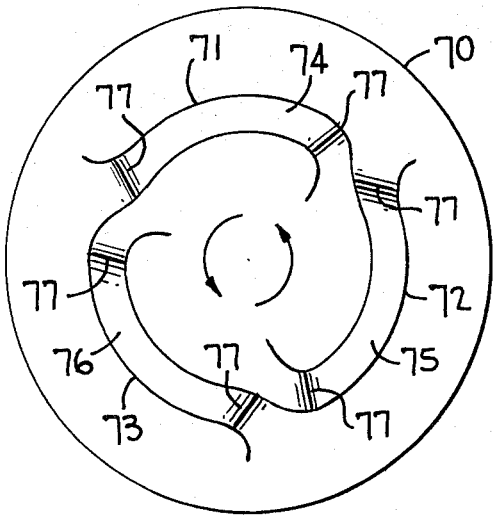
FIG. 8 is a top plan view of still another embodiment of the present invention.
Figure 9:
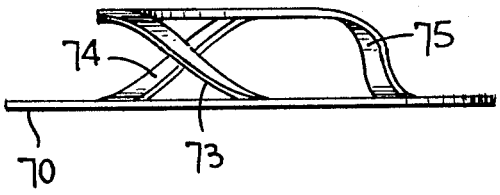
FIG. 9 is a side view in elevation of the embodiment of FIG. 8.

A third embodiment of the present invention is illustrated in FIGS. 8 and 9. A disc 70 includes three through-cuts 71, 72 and 73 disposed symmetrically at 120°-space locations. It will be apparent that more than three cuts can be used. Blade members 74, 75 and 76 are defined between these through-cuts. The through-cuts 71, 72 and 73 may take the same regular arcuate contour provided for through-cuts 11 through 18 and 51 through 54; however, it is preferable for this embodiment to provide through-cut contours which permit the blade members 74, 75 and 76 to be more readily bent or folded. The disc center is twisted relative to the rim, in the manner indicated by the arrows in FIG. 8, to provide the doming effect best seen in FIG. 9. Each blade member is then bent or folded at two locations 77, proximate its ends, so that the rotational translation between the center and rim of the disc can be maintained. Thus, the embodiment of FIGS. 8 and 9 requires only one piece, namely the disc, and eliminates the need for a cross-piece or strip to effect doming.

While I have described and illustrated a plurality of embodiments of my invention, it will be clear that variations of the details of construction which are specifically illustrated and described may be resorted to without departing from the true spirit and scope of the invention as defined in the appended claims.

What I claim is:

1. A flying saucer type toy comprising:

a flat disc member having a central region and a rim and plural through-cuts defined therethrough and extending in a generally spiral manner from said central region toward said rim to define blade portions between said through-cuts; and means for securing said central portion out-of-plane with respect to said rim to create generally spiral-shaped spaces between said blade portions, said means for securing comprising a support member secured to diametrically-opposed locations of said rim;

whereby upon spinning said disc about an axis perpendicular to said central portion, air flows through said spiral-shaped spaces to impart a lift force to the disc related to the spin velocity;

said means including:

at least one strip member having a length at least equal to the distance between diametrically opposed locations on said rim;

support means for securing said strip proximate its mid-point to the central region of said disc such that any rotation of said strip relative to said rim produces similar rotation of said central region relative to said rim; and engagement means for securing the ends of said strip to said diametrically opposed points on said rim which correspond to a position of said strip which is rotated relative to said rim sufficiently to force said central region out of the plane of said rim.

2. The toy according to claim 1 wherein said engagement means comprises a pair of diametrically-opposed and radially-extending slots defined in said rim and tabs means defined at the ends of said strip for engaging said slots.

3. A flying saucer type toy comprising:

a flat semi-rigid disc member having a central region and a rim and plural through-cuts defined therethrough and extending in a generally spiral manner from said central region toward said rim to define blade portions between said through-cuts; and means for securing said central portion out-of-plane with respect to said rim to create generally spiral-shaped spaces between said blade portions said means for securing comprising a normally generally planar semi-rigid support member secured to diametrically-opposed locations of said rim;

said support member having a length when unstressed, which is different than the distance between said diametrically opposed locations so that a force is exerted by said disc member and said support member, each against the other, to deform said central portion out-of-plane with respect to said rim when said support member is secured to said diametrically-opposed locations of said rim, whereby upon spinning said disc about an axis perpendicular to said central portion, air flows through said spiral-shaped spaces to impart a lift force to the disc related to spin velocity.

4. The toy according to claim 3 wherein said support member is longer than the spacing between said diametrically opposed rim locations and is secured to extend flush along a surface of the disc so as to force the disc central region out of the plane of the rim.

5. The toy according to claim 3 wherein said support member is in the shape of a cross with four legs secured at 90°-spaced points on the disc rim, the portions of the legs subsisting being diametrically opposed pairs of points being longer than the distance along the disc between said opposed pairs of points, said cross being secured to extend flush along the disc and thereby force the disc central region out of plane of the rim.

6. The toy according to claims 3 or 4 made entirely of cardboard.

7. The toy according to claim 3, wherein said support member is also secured to said central region.

8. The method of imparting aerodynamic flight to a flat circular member having a central region in the form of a circle having as its center the geometric center of said member and a rim in the form of an annular portion disposed concentrically about and spaced from said central region, said method comprising the steps of:

(a) cutting said member to provide a plurality of spaced spiral-shaped cuts through the thickness of the member, each cut extending between said central region and said rim;

(b) attaching to said flat circular member a support element which deforms said member to support said central region out of the plane of said rim, with the regions between said cuts extending between said central region and rim to form a plurality of aerodynamic lift blades in said member; and (c) spinning said deformed member about an axis extending perpendicular to the deformed member and through its geometric center to cause air to flow along each of said lift blades in the same rotative sense.

* * * * *